US006928670B2

(12) United States Patent
Lochtefeld et al.

(10) Patent No.: US 6,928,670 B2
(45) Date of Patent: Aug. 16, 2005

(54) MOVING REEF WAVE GENERATOR

(75) Inventors: Thomas J. Lochtefeld, La Jolla, CA (US); Charles E. Sauerbier, Arroye Granda, CA (US)

(73) Assignee: Light Wave Ltd., Reno, NV (US)

( * ) Notice: Subject to any disclaimer, the term of this patent is extended or adjusted under 35 U.S.C. 154(b) by 0 days.

(21) Appl. No.: 10/319,595

(22) Filed: Dec. 16, 2002

(65) Prior Publication Data

US 2003/0119592 A1 Jun. 26, 2003

Related U.S. Application Data

(60) Provisional application No. 60/339,805, filed on Dec. 17, 2001.

(51) Int. Cl.[7] ..... E04H 4/14
(52) U.S. Cl. ..... 4/491; 405/79; 472/128
(58) Field of Search ..... 4/491; 405/79; 472/128

(56) References Cited

U.S. PATENT DOCUMENTS

| | | | | |
|---|---|---|---|---|
| 2,064,035 A | * | 12/1936 | Rynearson | 472/136 X |
| 3,005,207 A | | 10/1961 | Matrai | 4/491 |
| 3,473,334 A | | 10/1969 | Dexter | 405/79 |
| 3,557,559 A | | 1/1971 | Barr | 405/79 |
| 3,562,823 A | | 2/1971 | Koster | 4/491 |
| 3,789,612 A | | 2/1974 | Richard et al. | 405/79 |
| 3,802,697 A | | 4/1974 | LeMehaute | 482/51 |
| 3,851,476 A | | 12/1974 | Edwards | 405/25 |
| 3,913,332 A | | 10/1975 | Forsman | 405/79 |
| 4,522,535 A | | 6/1985 | Bastenhof | 405/79 |
| 4,662,781 A | | 5/1987 | Tinkler | 405/79 |
| 4,792,260 A | | 12/1988 | Sauerbier | 405/79 |
| 4,954,014 A | | 9/1990 | Sauerbier et al. | 405/79 |
| 5,000,110 A | | 3/1991 | Moore | 114/245 |
| 5,171,101 A | | 12/1992 | Sauerbier et al. | 405/79 |
| 5,342,145 A | * | 8/1994 | Cohen | 4/491 X |
| 5,664,910 A | | 9/1997 | Lochtefeld et al. | 405/79 |
| 5,766,082 A | | 6/1998 | Lochtefeld et al. | 472/117 |
| 5,860,766 A | | 1/1999 | Lochtefeld et al. | 405/79 |
| 5,911,190 A | | 6/1999 | Lochtefeld et al. | 114/274 |
| 6,105,527 A | | 8/2000 | Lochtefeld et al. | 114/125 |

FOREIGN PATENT DOCUMENTS

| | | |
|---|---|---|
| FR | 1.019.527 | 10/1952 |
| JP | 52-41392 | 3/1977 |

* cited by examiner

*Primary Examiner*—Robert M. Fetsuga
(74) *Attorney, Agent, or Firm*—J. John Shimazaki

(57) ABSTRACT

The invention relates to a wave generating system comprising a wave generator that travels along the surface of a body of water, and preferably in the middle thereof, wherein the wave generator can create both primary and secondary waves that travel toward the shore. The primary waves are intended to allow surfing maneuvers to be performed in a relatively deep water environment. In the preferred embodiment, the body of water has opposing undulating shorelines upon which the secondary waves can break, wherein by modifying the shoreline's slope and curvature, and providing undulating peninsulas and cove areas, various multiple wave formations and effects can be created.

29 Claims, 4 Drawing Sheets

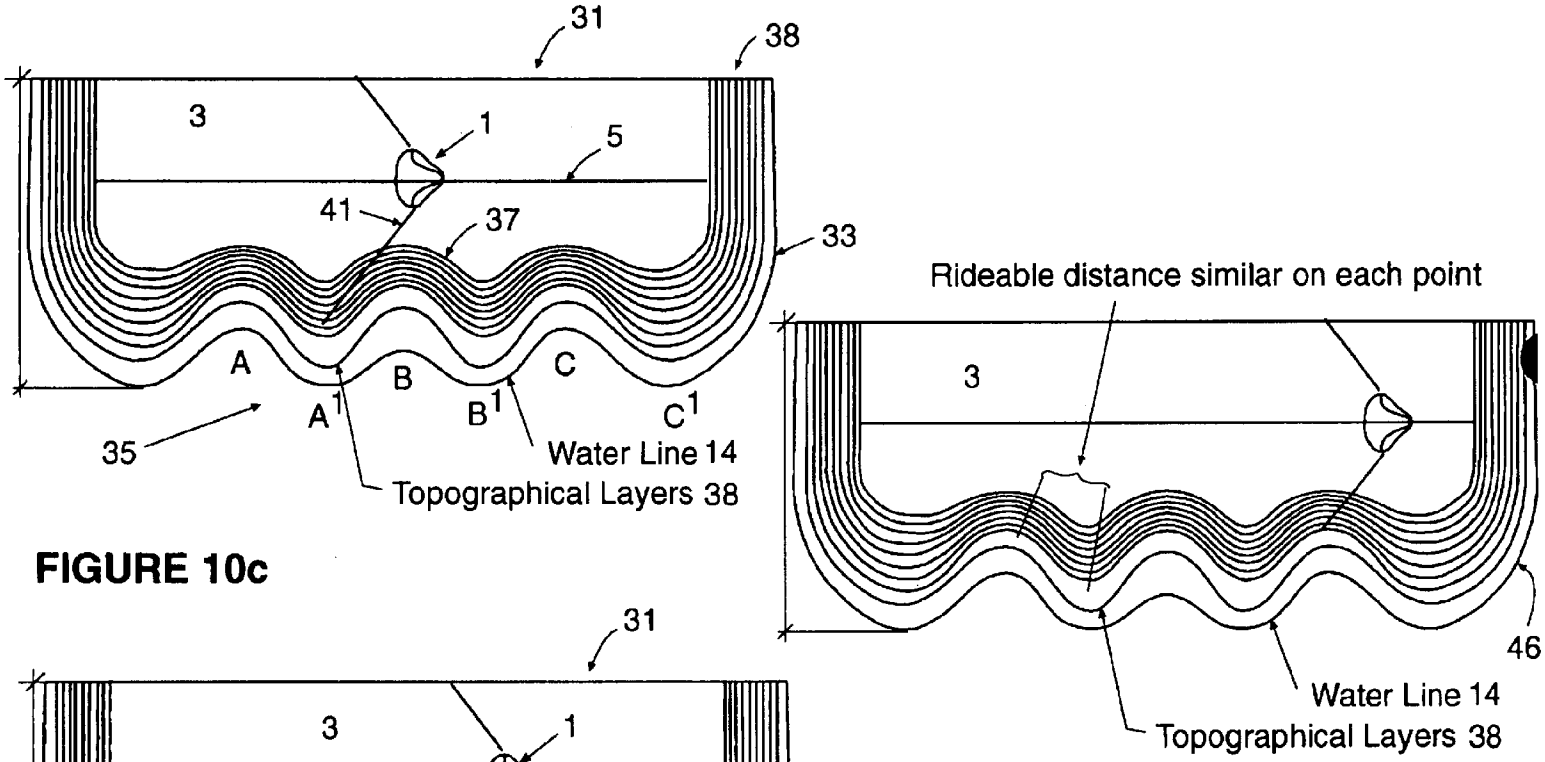
FIGURE 10e
FIGURE 10c
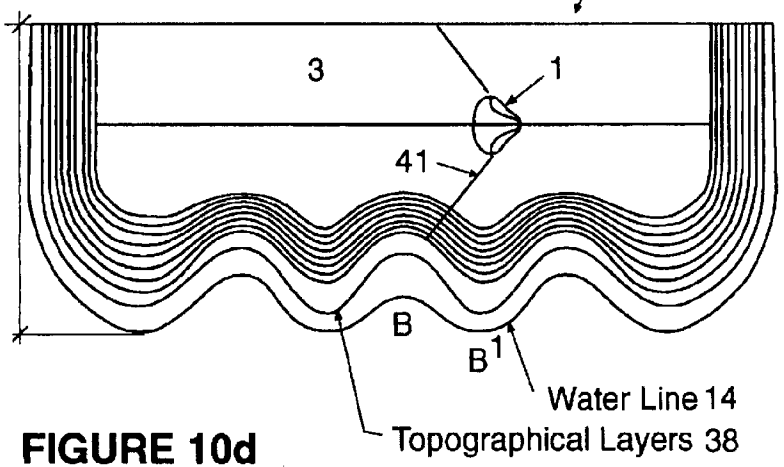
FIGURE 10d

MOVING REEF WAVE GENERATOR

RELATED APPLICATION

This application claims the benefit of the filing date of U.S. Provisional Application Ser. No. 60/339,805, filed on Dec. 17, 2001.

FIELD OF THE INVENTION

The present invention relates to a wave generating system, and in particular, to a wave generating system adapted to travel within a body of water having an extended shore with wave enhancing curvatures and slopes thereon.

BACKGROUND OF THE INVENTION

Water theme parks have become popular in recent years. Water theme parks generally consist of water rides and often provide other water related activities.

An attraction that has become popular at many water theme parks throughout the country is the wave pool. Wave pools are typically man-made bodies of water wherein a wave generator is located at one end of the pool, and a simulated beach is located at the other end, wherein waves are created by the wave generator that travel across the pool and break onto the beach. In particular, attempts have been made to create spilling, breaking waves using mechanical wave generators that are designed to push large amounts of water back and forth in the pool. This movement is created on the deep end of the pool and involves creating waves that travel toward the opposite shallower end where the waves break. These generators are often driven by motors, such as those that are mechanically, pneumatically, or hydraulically operated.

While many different methods have been attempted, one of the shortcomings of wave pools is that they typically create waves by moving water back and forth, and therefore, can only create a single wave at a time. That is, in most wave pools, only a single periodic wave can be created by the wave generator at any given moment in time, wherein the passage of time is required between successive waves. This requires one wave to pass before another is created. Although different sized and shaped beaches can be provided, and wave frequencies can be increased, only one wave is created at one time. In such circumstances, particularly when wave pools are crowded, there is often little space or opportunity for participants to ride the waves. Either the occupancy of the wave pool must be limited, or larger wave pools with additional wave generating capacity must be provided, in order for more people to enjoy the waves.

Conventional wave pools also typically only have a single sloped beach area upon which the waves will break. In such case, people who want to perform water skimming maneuvers in the shallow areas near the beach often have to share the same space with those who simply want to wade, such as children and the elderly, which can disadvantageously increase the risk of accident and create an overcrowded situation within the pool.

The unavailability of usable space within the wave pool also makes it difficult to create surfable quality waves and for participants to take advantage of the waves that are produced. In conventional wave pools, water is moved back and forth on one end of the pool, and the waves created by this movement must travel across the pool, and then be acted upon by the inclined surface of the pool floor (for the waves to form and eventually break). In this respect, there must be sufficient length within the pool for the waves to travel far enough to curl and finally spill onto the beach. Also, even if surfable quality waves can be created, competition for space within the pool can make it difficult for participants to perform surfing and skimming maneuvers on the waves that are created.

In view of the limitations of existing wave pools, as outlined above, the invention described herein is concerned with a wave pool that produces various wave formations on which water skimming and surfing maneuvers can be performed, and that increases the number and variety of wave formations that can be created, so that participants with different interests and skills can co-exist and play at the same time in the same pool.

SUMMARY OF THE INVENTION

The present invention relates to a wave generating system that increases the amount of throughput and usable space provided by a wave pool, and produces various wave formations on which water skimming and surfing maneuvers can safely be performed.

One aspect of the present invention involves providing a wave generator located within the middle of the wave pool which travels from one end of the pool to the other along a submerged track. The track is preferably located on the pool floor, and enables the wave generator to slide thereon, in a manner that allows the wave generator to travel along the surface of the body of water, wherein waves that travel outwardly from the wave generator toward the shoreline can be created thereby.

In one embodiment, the wave generator can create both primary and secondary waves that expand outward toward opposite sides of the shore, wherein the primary waves are formed in close proximity to the wave generator (to enable surfing maneuvers to be performed in a relatively deep water environment), and the secondary waves are created by the displacement of water caused by the wave generator, and travel in opposite directions toward the shore.

By virtue of creating waves in this manner, two sets of primary and secondary waves can be created at any given time by a single wave generator, wherein two primary waves travel outwardly from the wave generator in opposite directions, and two secondary waves travel in opposite directions toward opposing shorelines, wherein each secondary wave can then be acted upon by the inclined pool floor to create curling, spilling, plunging, collapsing and/or surging type breaking waves along the shore. By positioning the track in substantially the middle of the pool in this manner, and providing separate shorelines with beaches on opposite sides of the track, the wave generator of the present invention can create two sets of primary and secondary waves, traveling in opposite directions toward opposing sides of the pool, wherein unique primary wave formations for performing surfing maneuvers in a relatively deep water environment, and secondary waves traveling toward two opposing shorelines can be created. In this last respect, variations along the pool floor can create various wave effects and formations upon which surfing and skimming maneuvers, as well as wading activities, can be performed.

The wave generator of the present invention, and the effects it creates, are preferably similar to those previously disclosed in U.S. Pat. Nos. 6,105,527; 5,911,190; 5,860,766; 5,664,910, which are incorporated herein by reference. The wave generator of the present invention is preferably a wave forming device that can be pulled and/or pushed through a body of water in a relatively deep water environment. The wave generator preferably has wave forming surfaces that are designed to act upon the surface of the water as it is pulled by a sled along the submerged track, wherein a cable attached to the sled can be used to pull the sled.

As the wave generator moves along the water surface in this manner, the wave generator preferably displaces water in a manner that creates surfable quality waves. In the preferred embodiment, the wave generator preferably has leading edges that are capable of cutting and lifting water upward, and/or pushing water outward. Wave forming surfaces are extended behind the leading edges, wherein they are preferably curved upward and outward in a concave manner, in both horizontal and vertical directions, to enable water to be lifted up, and displaced laterally outward, away from the wave generator. In this manner, when the wave generator travels through water, it cuts through and displaces water in a manner that helps to create various wave formations, including both primary and secondary waves.

The depth at which the wave generator's leading edges are positioned relative to the water surface preferably determines the thickness of the primary wave formations, insofar as the depth controls the amount of water that is lifted up and displaced by the wave generator. The deeper the leading edges of the wave generator are positioned in relation to the water surface, the more water that can be lifted and pushed upward by the wave generator, thereby enabling the wave generator to create relatively thick primary waves. The shallower the leading edges are positioned in relation to the water surface, on the other hand, the less water that can be lifted and pushed upward by the wave generator, thereby enabling the wave generator to create relatively thin waves. In this respect, the wave generator is preferably maintained at a level and in a manner that helps to keep the leading edges at a substantially constant level in the water, i.e., along the surface of the water, such that when the wave generator moves through the water, the leading edges help to scoop up a sheet flow of water having a relatively uniform thickness upwardly and laterally as conducive to surfing.

In this respect, the wave generator of the present invention is preferably connected to a sled or other mechanism that rolls, slides, or is pulled/pushed along the submerged track, wherein a stem is extended between the sled and wave generator in a manner that helps to keep the leading edges of the wave generator at a substantially constant level in the water, i.e., just below the surface of the water. Mounting the wave generator on a rigid stem extending from the sled at a predetermined distance allows the depth at which the leading edges travel in the water to be maintained relatively constant. In another embodiment, the wave generator can be made buoyant, and can be pulled by a cable at a predetermined distance from the sled to help maintain the leading edges at the appropriate depth.

In the rigid stem embodiment, because it is not always easy to maintain the level of water constant, i.e., due to temperature and weather changes, or other variances, the stem can be made adjustable so that the wave generator can be positioned at different levels, depending on how much water is in the pool. The adjustability of the stem can be provided, for example, by using telescoping members, with a fastening means that allows the wave generator to be set at a predetermined distance above the sled.

Preferably, the wave generator has two substantially identical wave generating surfaces on either side, wherein each one is capable of creating wave formations that travel in opposite directions. The wave generator preferably has symmetrical leading edges and wave forming surfaces that help to displace water uniformly and in opposite directions, thereby creating a relatively balanced V shaped wake. The V shaped wake, in turn, helps to create two mirror-image wave formations that flow in opposite directions toward the shore.

In another embodiment, the wave generator can be adapted with only one wave generating surface on one side, such that only one primary wave is created thereby. This embodiment is preferably used in wave pools that are smaller and only have one shoreline or beach along which the waves break.

The wave generator also preferably travels in two directions along the track. This way, it can generate waves traveling in one direction, and then generate additional waves travelling in the other direction, i.e., back and forth along the track. For example, in one embodiment, the wave generator can be adapted to pivot at the end of the track, so that the direction that the forward end faces can easily be reversed. This way, when the wave generator reaches one end of the track, the wave generator can be turned around, and then pulled in the other direction, to create primary and secondary waves traveling in the opposite direction. And, when the wave generator reaches the other end of the track, the wave generator can be turned around again, wherein it can then be pulled back in the opposite direction, to create more primary and secondary waves. This back and forth movement can be repeated over and over to create waves that travel in opposite directions continuously.

In another embodiment, the wave generator can have dual wave generating surfaces, each facing opposite directions. This way, rather than having to pivot the wave generator when it comes to a stop at the end of the track, it preferably has two sets of leading edges and wave forming surfaces facing opposite directions, so that the wave generator can simply be pulled in two directions, to create primary and secondary waves traveling in opposite directions.

Based on the above, the present invention contemplates that the wave generator of the present invention can create four different wave formations that travel in four different directions, i.e., two that expand outward in the shape of a V in one direction, and another two that expand outward in the shape of a V in the opposite direction.

Another aspect of the present invention preferably involves employing beach areas or shorelines with undulating patterns having predetermined curvatures and slopes, etc., designed to increase the number and types of curling, spilling and/or breaking wave formations that can be created by a single solitary wave. This aspect of the invention is preferably accomplished by providing an undulating shoreline (i.e., with intermittent peninsula and cove areas) that can cause each secondary wave to break in one manner in one area, and in another manner in another area, etc. The undulations are preferably provided so that as the waves travel toward the shore and break, the breaking sequences can be repeated over and over along the two shorelines. And, depending on how many undulating areas are provided, a predetermined number of wave formations can be created along the shoreline, thereby providing multiple opportunities for participants to ride the waves.

In the present invention, the curvatures, slopes and patterns of the shoreline preferably serve to enhance the wave formations formed by the wave generator, and create additional wave effects along the shore. In this respect, the shoreline is preferably adapted so that it can create additional waves and wave formations from a single secondary wave. As the secondary wave travels through the water, it can be affected by the slope and curvature of not only the pool floor, but the curvature and slope of the shoreline, such that as the wave travels further toward and/or across the shoreline, it can form multiple wave formations, each capable of breaking independently on the beach. This can be accomplished, for example, by the undulation of the shoreline, with intermittent peninsulas and cove areas, which are preferably extended along both sides of the shore.

The creation of these different and multiple wave formations enables a wide variety of water skimming and surfing maneuvers to be performed at the same time at various locations within the same pool. For example, the present invention preferably creates primary waves upon which participants can perform surfing maneuvers in a relatively deep water environment (near the wave generator). The present invention also creates additional secondary waves and wave formations, which in turn, create additional wave effects along the undulating shorelines, on which many other participants can perform additional surfing and/or water skinning maneuvers. The present invention also provides multiple areas within the pool where participants can simply wade in shallow water, without interruption and interference by any other participant.

The wave formations also enable participants to easily enter into and exit from the ridable areas of the breaking waves, from any of many different locations on the shoreline. And, because of the repetitive nature of the undulations, substantially identical wave formations and characteristics can be duplicated from one area to the next, thereby increasing predictability and safety.

In another embodiment, one side of the pool is preferably provided with an undulated beach area, and the other side, i.e., the side opposite the track, is provided with a containment wall. This embodiment can be used in areas where the size of the pool must be limited due to space limitations. The wave generator in this embodiment is preferably the kind that has only one wave forming surface on one side, as discussed above, to create wave formations that travel toward one side of the pool. Because asymmetrical forces would necessarily act upon the wave generator as it travels through the water, however, the wave generator in this embodiment is preferably symmetrical to the axis of travel and either (1) secured to a sled running along a track in a manner that helps maintain the wave generator in substantial equilibrium, i.e., to keep it moving in the direction of travel without being tilted or pushed sideways from the path, or (2) pulled by a cable wherein the hydraulic interaction between generator and water is balanced to achieve a stable steady state flow condition.

BRIEF DESCRIPTION OF THE DRAWINGS

FIGS. 10*a* through 10*e* are provided to show the movement of the wave generator and the waves created thereby as it travels across the pool, wherein each figure represents a point in time showing how the waves travel and break along the undulated shoreline.

DETAILED DESCRIPTION OF THE INVENTION

Figure 1:
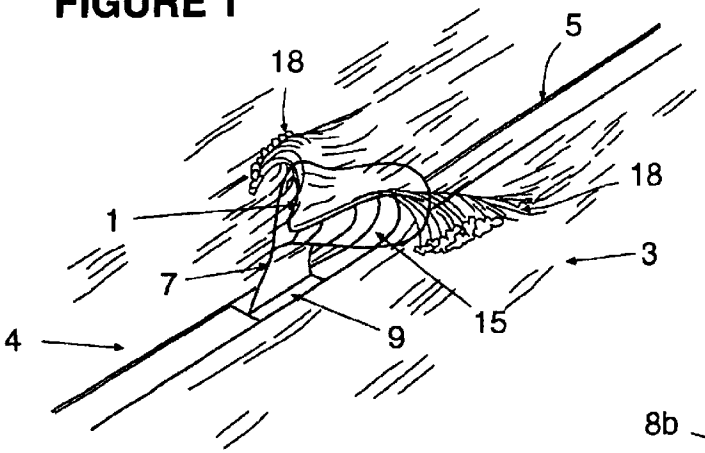
FIG. 1 is a perspective view of the wave generator of the present invention being pulled across a wave pool.

FIG. 1 represents a perspective view of the wave generator 1 of the present invention in operation traveling through a body of water 3 on a submerged track 5. The wave generator 1 preferably travels partially submerged along the surface of the body of water 3 such that it can displace water and create primary and secondary waves, as will be discussed. The track 5 is preferably substantially straight and extends along a substantially horizontal floor 4 of the body of water 3. The track 5 is preferably designed so that the wave generator 1 can travel on a sled 9, which is adapted to travel along the track 5. The wave generator 1 is preferably mounted to a connector or stem 7 extending upward from the sled 9, such that the wave generator 1 can travel along and/or just under the water surface.

Figure 2:
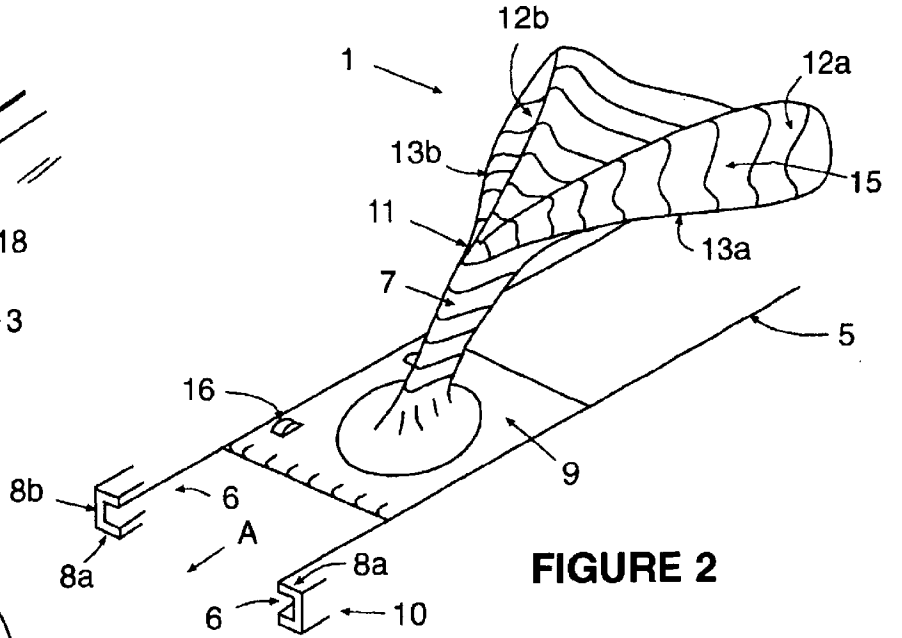
FIG. 2 is a perspective view of the wave generator of the present invention positioned on a sled that runs on a track.

In one embodiment, the submerged track 5 is comprised of a pair of channels 10, as shown in FIG. 2, extending longitudinally in the direction of travel A, wherein the channels 10 are preferably located a predetermined distance apart from one another, so that the sled 9, having a predetermined width, can be slidably mounted therebetween. The two channels 10 are preferably positioned with their flanges 8*a* facing toward each other, wherein the flanges 8*a* form grooves 6, in which the sled 9 can roll or slide. In this respect, the sled 9 is preferably adapted to roll or slide within the grooves 6 between the flanges 8*a* in a longitudinal direction A, wherein the web portion 8*b* of each channel 10 preferably help to prevent the sled from moving side-to-side, while the flanges 8*a* can maintain the sled 9 in a substantially horizontal orientation. This substantially prevents tilting and other undesirable movements along the track 5.

The sled 9 can, in one embodiment, be adapted to slide within the channels 10, using only water as the lubricant, wherein by adapting the wave generator 1 to move 5 freely within the body of water 3, the sled 9 can be adapted to slide relatively freely within the channels 10, without any additional mechanical means. For example, the wave generator 1 can be adapted to float so that its buoyancy reduces the effective weight of the wave generator 1 on the track 5, wherein the sled 9 can then slide through the channels 10 with very little friction being applied.

In another embodiment, the sled 9 can have a plurality of rollers 16, as shown in FIG. 2, which can extend from the top and bottom surfaces of the sled 9, and along the front and back ends of the sled 9, on either side thereof. The rollers 16 are preferably adapted to be positioned within the body of the sled 9 and extend upward and downward to engage the flanges 8*a*, such that they allow the sled 9 to roll or slide freely within the grooves 6, as the sled 9 is pulled through the water. In this manner, as the wave generator 1 travels through water, and hydrodynamic drag is experienced by the wave generator 1, any tendency of the wave generator 1 to tilt backward can be resisted by the rollers 16 applying upward pressure in the front and downward pressure in the back, i.e., against the upper and lower flanges 8*a*, respectively. Although the embodiment with rollers 16 is shown, other types of tracks that enable the wave generator 1 to slide freely, such as those used in the operation of trains, monorails, roller coasters, conveying systems, etc., can also be used, and are within the contemplation of the present invention.

The wave generator 1 itself is essentially a wave forming device that is adapted to travel substantially along and under the surface of the body of water 3 to cause water to be displaced in a manner that creates primary and secondary waves, much like a boat traveling through water. As shown in FIG. 2, it preferably has a double hull design which, as it is being pulled through the water, can displace water in two different directions, i.e., in the shape of a V, away from the wave generator 1. As shown in FIG. 2, the wave generator 1 preferably has two leading edges 13*a* and 13*b*, which are part of two wave generating hulls, 12*a* and 12*b*, extending from a forward end 11. The hulls preferably sweep substantially rearward from the leading edges 13*a* and 13*b*, forming two wave forming surfacdes 15 thereon. The leading edges 13*a* and 13*b* are designed to travel below the water surface, such that they can cut through and scoop up water to form a sheet flow of water that flows onto the flow forming surfaces 15. The leading edges 13*a* and 13*b* are preferably substantially rounded and covered with a soft material, as will be discussed, so as to reduce the risk of injury.

Figure 3A:
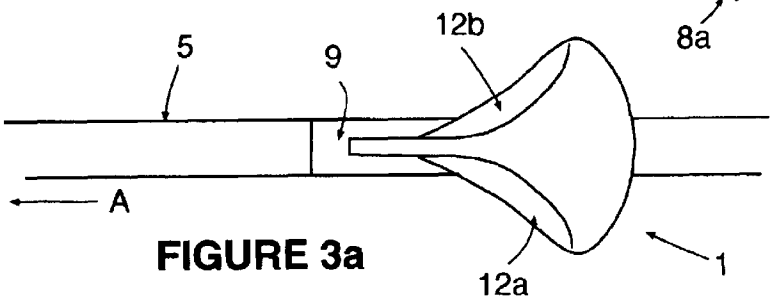
FIG. 3*a* is an overhead view of the wave generator of the present invention.
Figure 3B:
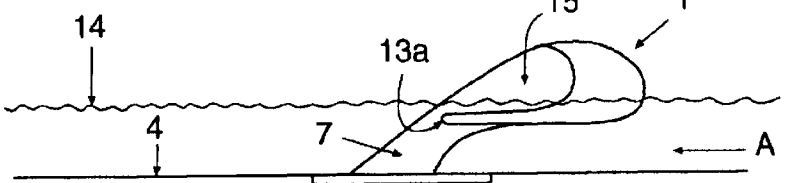
FIG. 3*b* is a side view of the wave generator of the present invention showing its relationship to the water line.

The flow forming surfaces 15 preferably have both horizontal and vertical concave curvatures, such that as water is lifted up onto the hulls, 12*a* and 12*b*, the sheet flow of water will conform to the contours of the flow forming surfaces 15. The hulls, 12*a* and 12*b*, preferably extend substantially horizontally outward at an angle, forming a substantial V-shape from above, as shown in FIG. 3*a*. The angle at which the hulls extend rearward is preferably between about 15 to 45 degrees in relation to the direction of travel A, although the actual angle can vary.

The wave generator 1 has an inclined concave curvature which causes water flowing over the flow forming surfaces 15 to flow in an upward, lateral and ultimately forward direction, relative to the surrounding water, as it moves through the water. The hulls 12*a* and 12*b* are preferably oriented substantially laterally at an angle, as discussed above, which can cause the sheet flow of water to flow upward and laterally across the flow forming surfaces 15, forming substantially identical wave shapes 18 on either side of the wave generator 1.

The incline and/or the degree of curvature of the flow forming surfaces 15 and their lateral orientations determines the amount of forward, upward and lateral momentum exerted on the sheet flow of water, as the wave generator I travels through water, and functional to the speed of the wave generator 1 through the water, the size, character, and height of the wave shapes. For example, if the flow forming surfaces 15 have a relatively steep incline, and/or a relatively concave curvature, the wave shapes that are formed are likely to be relatively steep and of a plunging character. Conversely, if the flow forming surfaces 15 have a relatively shallow incline, and/or relatively open curvature, the wave shapes that are formed are likely to have less of an incline and an unbroken or spilling character. In addition, if the angle of lateral orientation is relatively wide, the wave generator 1 is likely to impart a greater lateral momentum to the water as water flows across the flow forming surfaces 15, wherein water is likely to flow further laterally away from the wave generator 1 as it travels through the water. On the other hand, if the wave generator 1 is made relatively narrow, the wave generator 1 is likely to impart only a small amount of lateral momentum to the water, wherein less lateral trajectory is likely to be created.

In the preferred embodiment, the wave generator 1 is preferably symmetrical in configuration, such that as it travels through water, the hydrodynamic forces acting on the generator 1 help to keep it aligned in the direction of travel A. That is, the double hull design preferably extends substantially identically on both sides of the forward end 11, wherein the hulls 12*a* and 12*b* can experience substantially identical hydrodynamic forces, tending to stabilize the device in a forward direction.

Keeping the wave generator 1 substantially level, and the leading edges 13*a* and 13*b* at a substantially constant depth in the water, are important aspects to the successful formation of wave shapes 18. The depth of the leading edges 13*a* and 13*b* relative to the water surface level 14, can determine the thickness and consistency of the sheet flow of water lifted onto the flow forming surfaces 15, wherein it can determine the overall size and consistency of the primary wave shapes 18. In this respect, the wave generator 1 is preferably designed so that the leading edges 13*a* and 13*b* are consistently maintained below the water surface at between 8 to 36 inches, which is sufficient to pare the top layer of water that passes up onto the flow forming surfaces 15, and allow the downward gravitational force to interact with the upward flow and cause the resultant wave effect.

Figure 4:
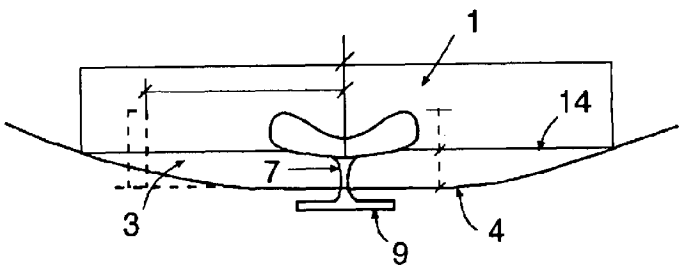
FIG. 4 is a front view of the wave generator of the present invention positioned within the wave pool.

In one embodiment, the wave generator 1 is connected to the stem 7 that extends upward from the sled 9, such that the hulls 12*a* and 12*b* extend substantially above the water line 14, as shown in FIG. 4. The wave generator 1, in this respect, is preferably designed to be rigidly mounted to the sled 9 such that the height of the wave generator 1, and in particular, the leading edges 13*a* and 13*b*, in relation to the sled 9, can remain substantially constant. Rigidly mounting the wave generator 1 to the sled 9, in this respect, enables the tilt of the hull to be controlled so that the proper orientation of the leading edges 13*a* and 13*b*, and of the flow forming surfaces 15, in relation to the body of water 3, can be achieved.

Because it is difficult to control the level of the water in the body of water 3, due to evaporation, rain and other conditions, etc., the present invention contemplates that the stem 7 can be provided with an adjustability feature, such that the height of the wave generator 1 in relation to the sled 9 can be adjusted. This can be accomplished, for example, by adapting the stem 7 with telescoping members and a holding means to maintain the wave generator 1 at a proper adjustable height. In this respect, any of many conventional methods of adjusting and controlling the height of the wave generator 1 on the stem 7 can be used.

In another embodiment, the wave generator 1 can be made of buoyant material so that it floats on the surface of the water. In this embodiment, the wave generator 1 can be pulled by the sled 9 with a separate cable (extending between the sled 9 and wave generator 1), and is preferably adapted to be symmetrical in design so that it can remain in substantial hydrodynamic equilibrium, and at a substantially constant level in the water, as the wave generator 1 travels through the water. Various buoyancy and planing forces, as well as the weight and drag forces that can be applied, are preferably taken into consideration, to adapt the wave generator 1 in this manner. For a better understanding of the different designs that are possible, which could affect the way the wave generator 1 can travel through the water, and how the wave generator 1 can be designed to account for these forces, resort should be made to U.S. Pat. No. 5,664,910, which is incorporated herein by reference.

In either embodiment, when the wave generator 1 is accelerated through water, hydrodynamic forces can act upon the hulls 12*a* and 12*b*, making it difficult, on the basis of the buoyancy and weight alone, to keep the wave generator 1 in substantial equilibrium. The shape of the wave generator 1, therefore, in conjunction with its weight and buoyancy, is preferably designed to help stabilize the wave generator 1 in the water, even during rapid acceleration. Water flowing over the wave generator 1, for instance, can create a downward force, as water is lifted up onto the flow forming surfaces 15, wherein the speed and angle at which the generator 1 travels can be affected. Pulling the wave generator 1 through the water can also cause the generator 1 to tilt backward as hydrodynamic drag is experienced by the hulls 12*a* and 12*b*, with the forward end 11 tilting up. To counteract these forces, and to maintain the leading edges 13*a* and 13*b* at a substantially constant level in the water, the wave generator 1 can be rigidly connected to the stem 7, which can be rigidly connected to the sled 9, which is preferably made wide and long enough so that it can be held in a substantially horizontal position within the channels 10, as discussed above.

Either with or without the stem 7, the wave generator I is preferably made of buoyant material, such that it can stay afloat in the water, which can reduce drag that may otherwise exist as it travels along the track 5. For example, by providing the wave generator 1 of the present invention with the appropriate amount of buoyancy, the effective weight of the wave generator can be minimized, such that the sled 9 can slide within the grooves 6 of the track 5 with very little friction, i.e., with water as the lubricant. By making the wave generator 1 virtually weightless in water in this manner, the sled 9 can be adapted to slide relatively freely within the grooves 6.

The buoyancy of the wave generator can be made possible 1) by the materials that are used, 2) by making the wave generator hollow, 3) by inserting air pockets into the wave generator where needed, or 4) any other known method. The wave generator can be made hollow, such as with a double wall design, or air pockets of various sizes, and at various locations, can be dispersed within its body, wherever additional buoyancy is needed.

Virtually any type of material used in the manufacture of boats can be used to manufacture the wave generator 1 of the present invention. The wave generator 1 is preferably made of a strong, durable, slightly flexible material, such as fiberglass, wood, metal or carbon graphite composite. The wave generator 1 is also preferably integrally formed, i.e., a fiberglass shell, and manufactured by a conventional hand lay up or injection mold process. The wave generator 1 is preferably made strong enough to withstand the impact of sheer, torsion, and bending, that can be caused by the hydrodynamic forces acting on it during operation. The exterior of the wave generator 1 should be covered by a soft, impact absorbent material, such as coated foam, or other material that is easy to apply. This covering material is preferably flexible so that the wave generator 1 will not cause injury to riders, who may fall or be accidentally struck during use. In addition, the wave generator 1 should be coated with a waterproof, or water resistant material, such as urethane rubber, which has a low coefficient of friction, and can be formed without seams, so that hydrodynamic drag can be minimized. The outer layer or coating can be applied in any conventional manner, such as by spray, glue, thermal heating, welding, or other method. The sled 9, stem 7 and track 5 components, as well as the rollers 16, can be made of any conventional rust resistant material, such as stainless steel, aluminum, plastic, carbon graphite, fiberglass, etc. The body of water 3 is preferably formed with and supported by concrete or other suitable stable material that can withstand wave action. The surface of the floor is also preferably coated with a water proof material to prevent seepage.

Figure 5:
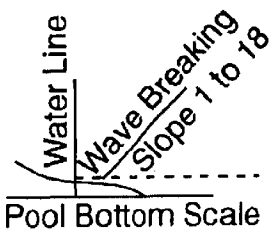
FIG. 5 is a schematic top view of the mechanical driving means and cable used to pull the wave generator through the pool.
Figure 5:
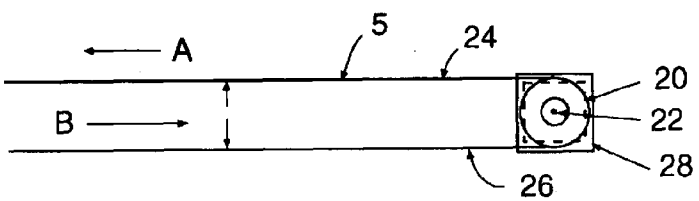
Figure 6:
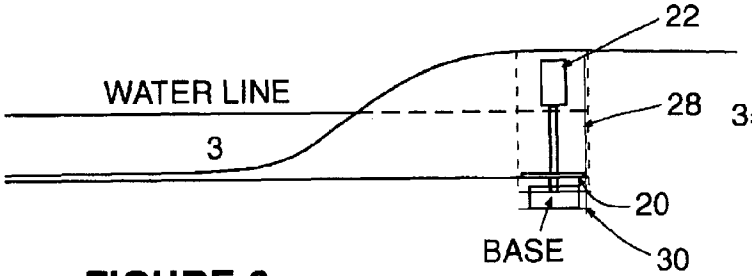
FIG. 6 is a schematic side view of the mechanical driving means and cable of the present invention.

The wave generator 1 of the present invention is preferably driven by a conventional drive motor 22, such as those that have been used to power trains, funiculars, cable cars, ski lifts, trolleys, etc. As shown in FIGS. 5 and 6, the drive motor 22 can be connected to bull wheels 20 that are designed to rotate and drive a cable loop 24 that has been pretensioned and extended across the body of water 3. In this embodiment, there are preferably two wheels 20, each at opposite ends of the track 5, with the cable loop 24 pretensioned to span the distance therebetween, wherein by rotating the drive motor 22, the cable loop 24 can be rotated to move the cable 24 through the body of water. In this fashion, by connecting the wave generator 1 to the sled 9, and attaching the sled 9 to the cable loop 24, and then rotating the wheels 20 with the drive motor 22, the sled 9 can be pulled along the track 5, across the body of water 3, which in turn pulls the wave generator 1.

The cable loop 24 can be laid in slotted sleeves 26 underneath the track 5 so that it will not interfere with the movement of the sled 9, nor be visible or accessible from above. A cable tension screw 28 can be provided to adjust the pretensioning of the cable loop 24 depending on how much slack is desired. An additional adjustment 30 can also be provided to control the vertical position of the wheel in relation to the floor 4. The present invention also contemplates that other conventional driving means and mechanisms can be provided to enable the wave generator 1 to travel across the body of water 3 along the track 5.

Another aspect of the present invention is that the wave generator 1 can be adapted to travel back and forth along the track 5 in opposite directions A and B. As discussed previously, the wave generator 1 and sled 9 are connected to the cable loop 24 which is driven by the wheels 20 that can be rotated in two different directions. By driving the wheels 20 in one direction, the wave generator 1 can be accelerated and driven in direction A across the body of water 3, and by driving the wheels 20 in the opposite direction, the wave generator 1 can be accelerated and driven in the opposite direction B. Alternatively, by connecting wave generator 1 to a cable loop 24 that is configured in a full circuit around wheels 20, a continuously moving generator can move in direction A, then, do a 180-degree turn around wheel 20 and move in direction B. This enables the wave generator 1 of the present invention to create various wave formations, including primary and secondary waves, traveling in both directions A and B.

The wave generator 1 is preferably adapted so that the wave generator hulls 12*a* and 12*b* can be reversed, i.e., so that they can face opposite directions at the appropriate time. This can be accomplished, for example, by providing a pivoting means on the sled 9, which allows the stem 7, and therefore, the wave generator 1, to rotate 180 degrees. This way, when the wave generator 1 travels in direction A, and comes to the end of the track 5, the wave generator 1 can be turned around to face the opposite direction, wherein the cable loop 24 can then drive the wave generator 1 in the opposite direction B, through the body of water 3, to create additional wave effects traveling in the opposite direction. By rotating the wave generator 1 in this fashion, the same wave generator 1 can be used to create wave formations in two different directions, In this embodiment, the stem 7, which is mounted on the sled 9, is preferably designed so that it can pivot around a vertical axis extending from the sled 9, such that when the wave generator 1 reaches the end of the track 5, the wave generator 1 can be rotated around the pivot point to face the opposite direction. For example, a vertical pylon can be extended from the sled 9 on which a fitted sleeve in the stem 7 can be provided, wherein the sleeve can be adapted to rotate about the pylon. Fastening means for maintaining the wave generator 1 in a predetermined rotational position on the sled 9 can also be provided.

The present invention also contemplates that the wave generator 1 can be made so that it is capable of being self-aligned, i.e., pivoted automatically. In this respect, the wave generator 1 can be adapted so that the pulling motion on the sled 9 by the cable 24 in one direction will cause the wave generator 1 to automatically swing or rotate around to the desired orientation. That is, simply pulling the sled 9 in one direction can cause the wave generator 1 to be oriented with the flow forming surfaces 15 facing that direction, whereas, when the wave generator 1 reaches the end of the track 5, and the cable 24 pulls the sled 9 in the opposite direction, the pulling motion in the opposite direction can cause the wave generator 1 to rotate and be oriented in the opposite direction automatically. This way, when the wave generator 1 reaches the end of the track 5, the system is adapted so that pulling the wave generator 1 with the cable 24 will, by virtue of the self-alignment feature, cause the wave generator 1 to be rotated to face the appropriate wave forming direction when needed.

In another embodiment, a drive motor can be provided on the sled 9 to enable the wave generator 1 to be rotated if desired. That is, a motor can be provided to rotate the stem 7 about the sled 9 when the wave generator 1 comes to a stop at the end of the track 5, such that the wave generator 1 can be positioned in the appropriate direction.

In another embodiment, the operation of the wave generator 1 can be computer programmed so that it can be pulled across the body of water 3, and then, when it comes to the end of the track 5, can automatically be rotated by the motor, wherein the wave generator 1 can then be pulled across the water in the opposite direction, wherein these steps can be repeated over and over, by running the program. A computer controller can, in this respect, be used to control the operation of the system.

The present invention also contemplates that the wave generator 1 can be designed with dual facing hulls, such that the wave generator 1 can be pulled in two different directions without having to rotate the wave generator 1. That is, a single wave generator can have 2 sets of wave generating hulls, 12*a* and 12*b*, including two sets of leading edges, 13*a* and 13*b*, and two sets of flow forming surfaces 15, that face in opposite directions, such that when the wave generator 1 reaches the end of the track 5, it simply has to be pulled in the opposite direction to create waves traveling in opposite directions.

The speed at which the wave generator 1 is pulled and travels through water is preferably about 8 to 16 miles per hour. The speed is sufficient to create both primary and secondary waves of sufficient size and shape for purposes of enabling surfing maneuvers to be performed on the primary waves, and the secondary waves to be formed which travel toward the shoreline.

A general discussion of wave creation principles will now be provided to help describe how the different waves and wave formations are created by the present invention. In general, the waves that are formed by the wave generator 1 of the present invention are created by the effect of gravity on the displacement of water caused by the wave generator's hull moving through water. A series of complex motions are typically created in the water as the wave generator 1 displaces water, which collectively help to form various wave formations, including both primary and secondary waves.

As water is displaced by the wave generator 1, the effect of gravity on the water displaced can cause various harmonic motions and water effects to occur. For example, a wave termed a "primary wave" is formed by the wave generator's hull as it travels through water, i.e., energy from the hull's movement is imparted directly to the water, causing water to be displaced forward, upward and away from the wave generator 1, forming a spilling or curling wave that spreads outwardly and laterally away from the wave generator 1 as it passes on.

"Secondary waves" are created by water displacement caused by the wave generator's hull moving through water, and in particular, by the pressure differential created between the water displaced (that builds up on the sides of the wave generator 1) and the hollow area displaced by the wave generator 1 under and behind it (the "hollow" or cavity created immediately behind the wave generator 1). This pressure differential naturally causes the water that builds up on the sides of the wave generator 1 to converge inwardly into the hollow area due to the restoring force of gravity. When the differential is great enough, the restoring forces can cause the water converging from both sides of the hollow to overshoot the equilibrium point, causing it to rebound, and form an "eruption" or peak that raises the water level on both sides to form a V shaped crest. This helps to create the secondary wave which spreads outwardly behind the wave generator 1 in the shape of a V, and in a manner that has sloped and angular components that travel toward the shore.

The combination of these movements in the water results in the creation of both primary and secondary waves. The primary wave, which is a wave that cascades directly from the flow forming surfaces 15 of the wave generator 1, is generally higher and steeper in shape than the secondary waves. In fact, under ideal circumstances, the primary waves are typically twice as high as the crests of the secondary waves along any point thereof. On the primary waves, surfing type maneuvers can be performed in a relatively deep water environment, since the flow forming surfaces 15 of the wave generator 1 form in effect a moving reef; whereas with secondary waves, the waves must travel toward the shore and be affected by the inclined slope of the shore before they will begin to curl and break.

Because the primary wave is created strictly by the influence of the wave generator 1 on the surface of the water, there is no need for the floor to be sloped for them to be created. In fact, in a deep water environment, the effect of the floor on the primary wave is negligible. This enables the wave generator 1 to be mounted to a substantially horizontal track 5 that runs along a substantially horizontal floor in a relatively deep water environment. Unlike the secondary waves, which require the pool floor to become shallower to impart friction and a breaking component to the waves, the primary waves are created in a relatively deep water environment, and cascade directly from the wave generator 1, as curling and plunging waves, near where the wave generator 1 travels. As shown in FIG. 4, it is contemplated that the level of water in the body of water 3 where the track 5 is located will preferably be about six feet deep. This depth is the preferred depth, i.e., it is deep enough so that the risk of injury is reduced, and shallow enough to reduce the cost of pool construction and water maintenance.

As a by-product of creating the primary waves, and the displacement of water created by the wave generator 1, the secondary waves are naturally created, which extend behind the wave generator 1, much like divergent stern waves behind a boat traveling through water. These secondary waves travel through deeper portions of the body of water 3 without being affected by the pool floor, and therefore, initially travel in the form of a wake, i.e., a non-breaking crest. Then, when they begin to encounter the inclined floor, and friction is imparted to the lower portions of the waves, the upper wave portions will naturally begin to speed up in relation to the lower wave portions, and the waves will begin to curl, spill, plunge and/or surge. The slope of the floor closer to the shore, which determines how the waves will break, is preferably in the range of between 1 to 6, and 1 to 18, to provide the appropriate effects needed to cause the waves to "break."

The slope of the floor can determine the type of wave that will be created and how the secondary wave will break. For example, where the secondary wave travels toward a relatively shallow slope, a "spilling breaker" wave can be created, which is characterized by a wedge shaped wave formation with foam and turbulence at the wave crest. Spilling in such case usually starts at some distance from the shore and is caused when a layer of water at the crest moves forward faster than the wave as a whole. Foam eventually covers the leading face of the wave. Such waves are characteristic of a gently sloping shoreline.

"Plunging breaker" waves are the most spectacular type of wave, and are created when the floor is shallow to intermediate in slope. The classic form of plunging breaker wave, which is what surfers typically like to ride on, is arched, with a convex back and concave front. The crest curls over and plunges downwards with considerable force, dissipating its energy over a short distance.

"Collapsing breaker" waves, as they are so called, are similar to plunging breaker waves, except that the waves are typically less steep, and instead of the crest curling over, the front face simply collapses. Such types of waves typically occur on beaches with intermediate to moderately steep slopes, and under moderate wave conditions.

Finally, "surging breaker" waves are found on the most steeply sloped beaches. Surging breakers are typically formed by long, low waves, wherein the front faces and crests remain relatively unbroken as the waves slide up the beach.

Although it is a matter of common knowledge that waves coming onto a sloped beach increase in height and steepness and eventually break, how the waves actually do this, and the factors that come into play in determining the extent of the height, steepness and shape of the waves, are dependent upon a number of variables. Some of the variables that come into play are: 1) the speed of the wave, 2) the slope of the beach, 3) the depth of the beach at any point along the wave, 4) the length of the wave, 5) the height of the wave, and 6) the total wave energy. Although there are mathematical formulas that attempt to define an empirical relationship between these factors, what actually happens during the transition of the waves from deep to shallow water is a difficult question to answer, particularly when the floor configuration and slope is ever-changing. Based on these factors, nevertheless, it has been determined that there are particular characteristics of wave formation that can be manipulated, to create ideal types and sizes of waves.

The present invention contemplates adapting the shoreline of the body of water termed a "wave pool" 31 in a manner intended to increase the functionality and usability of the waves that break onto the beach. Having discussed how the primary and secondary waves are generally created, and how the secondary waves can travel toward the shore and break, the present invention contemplates that the shoreline 33 can be provided with specific curvatures and slopes to maximize not only the number of breaking waves that can be created by a single secondary wave, but also the size and quality of those breaking waves.

Figure 7:
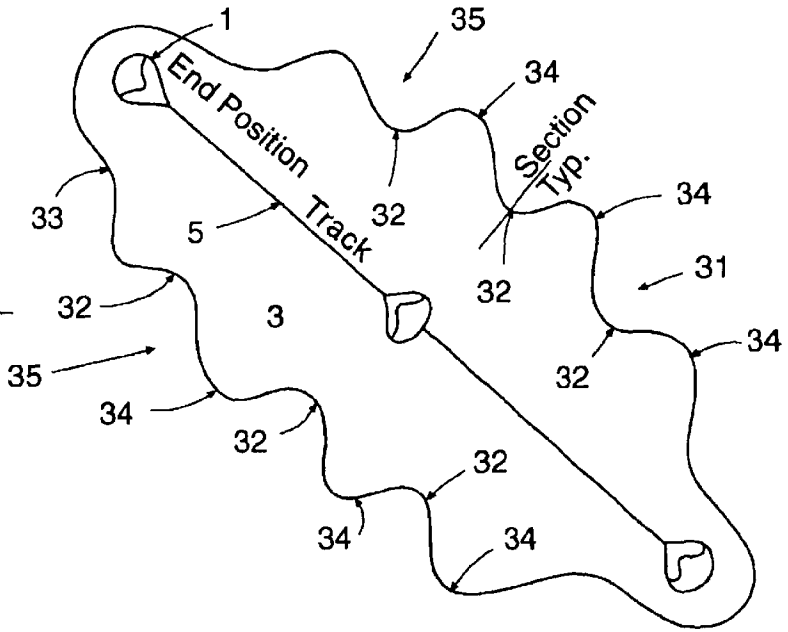
FIG. 7 is a plan view of one embodiment of the wave pool of the present invention having undulated shorelines on opposite sides of the pool, wherein the wave generator track extends substantially within the center of the pool.

In one aspect of the present invention, as shown in FIG. 7, the shoreline 33 upon which the secondary waves will break is provided with undulated patterns, i.e., a series of rounded peninsulas 32 and cove areas 34 having predetermined configurations and slopes, such that multiple waves and wave formations, which individually break onto different areas or beaches 35 extending along the edge of the wave pool 31, can be created along the shore. FIG. 7 shows an example of a shoreline 33 with two opposing beach areas 35 that are substantially identical in shape. The shoreline in this embodiment is preferably symmetrical in shape, and on either side, extends an equal distance away from the track 5 which preferably extends along the middle of the pool 7 from one end to another.

Figure 8:
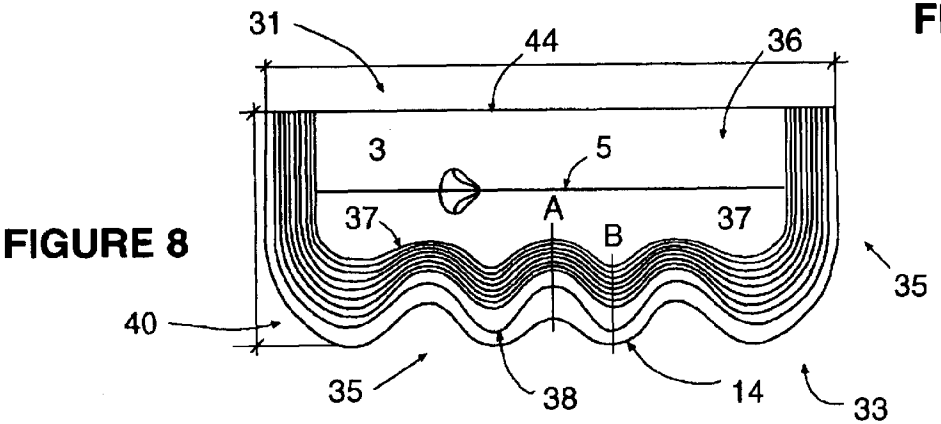
FIG. 8 is a plan view of an alternate embodiment of the wave pool of the present invention wherein there is a containment wall on one side thereof, and the undulating shoreline is provided on the other side.

As shown in FIG. 8, the wave pool 31 has a relatively horizontal floor portion 36 extending along the length of the pool where the track 5 extends. The horizontal floor portion 36 is provided to enable the track 5 to run substantially horizontally. Beyond the horizontal section, the pool floor extends upward and is raised to form an inclined contoured reef 37. The particular contours of the reef 37 can best be seen by the topographical lines 38 shown in FIG. 8, wherein each line represents a predetermined depth, which in the preferred embodiment, ranges from about six inches to one foot. Although the horizontal floor portion 36 is preferably about six feet deep, the reef 37 is preferably formed with a relatively steep, inclined and sloped area extending upward in an undulating pattern 40 from the deeper areas 36 to the beach areas 35. The steep areas preferably rise quickly along the undulated patterns 40 and then begin to level out to create a more moderate or intermediate slope that transitions through the water line 14 onto the beach areas 35. As seen in FIG. 8, there are approximately two topographical lines 38 that are relatively spaced far apart near the water line 14, showing that the inclined floor is relatively shallow near the beach areas. There are also a series of additional topographical lines that are closer together in the deeper water areas 36 of the reef 37, representing the steeper areas of the reef 37.

The wave pool 31 shown in FIG. 8 is actually representative of one that has a containment wall 44 on one side, which can be useful in situations where the size of the pool must be limited due to availability of space, rather than opposing shorelines as shown in FIG. 7. Nevertheless, it should be apparent that the shoreline 33 shown in FIG. 8 can be duplicated and provided on the opposite side of the pool, as shown in FIG. 7, to form substantially identical shorelines on opposing sides of the pool. In this respect, the shoreline 33 in FIG. 8 is intended to be substantially the same as the shorelines 33 shown in FIG. 7, i.e., the topographical lines 38 shown in FIG. 8 are intended to be representative of the contours that can be provided on the shorelines 33 in the embodiment of FIG. 7.

The preferred embodiment of the present invention has a series of undulating peninsula 32 and cove areas 34 forming a multiple number of curvatures and slopes. For ease of understanding, the following discussion will focus on a single undulating area between two adjacent peninsulas 32, as shown in FIG. 9.

Figure 9:
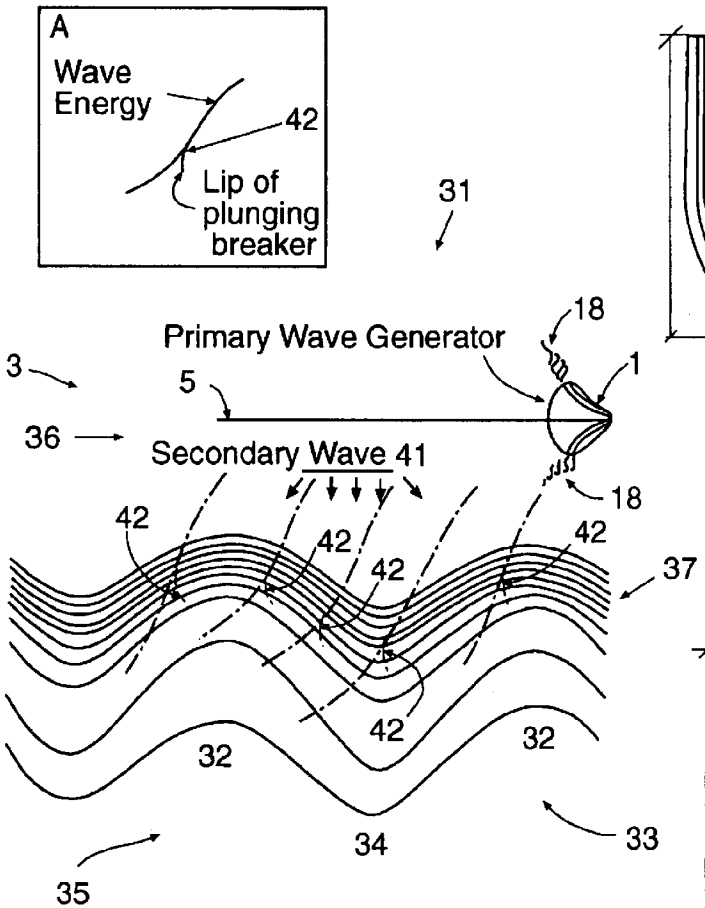
FIG. 9 is a partial plan view of an undulated shoreline showing the wave generator of the present invention moving along a track, wherein primary and secondary waves are generated by the wave generator, and the waves depicted are shown at preselected time intervals.

FIG. 9 depicts how a typical secondary wave 41 formed by a wave generator 1 would travel through the wave pool 31 and break along the shore 33. In this figure, as well as FIGS. 10*a* through 10*e*, an attempt has been made to create a time lapse view of the wave 41 and where it might break at any particular point in time, as the wave generator 1 passes across the pool 31. For example, in FIG. 9, each wave line 41 represents where the secondary wave 41 might be every 7 seconds or so when the wave generator 1 travels at the preferred speeds mentioned above.

The primary wave 18 is shown breaking away from the wave generator 1 in a relatively deep water area where floor 36 is preferably substantially horizontal. As the secondary wave 41 travels toward the shoreline 33, and begins to encounter the sloped surface of the reef 37, the leading edge of the secondary wave 41 begins to curl and break, as represented by lines 42. Due to the steepness of the reef 37 along the area just past the peninsula 32, the secondary wave 41 will typically form a plunging breaker wave at that location, wherein the lip of the wave is typically created at about a depth of about two to three feet (in cases where the deepest part of the pool is about six feet deep). This is represented by the third or fourth topographical line 38 in the body of water 3 in FIG. 9.

Because of the undulating shoreline 33, it can be seen that where the secondary waves 41 actually plunge or break shifts in accordance with the undulating pattern 40, i.e., depending upon where the topographical line with a depth of two to three feet lies along the shoreline 33. Also, at this juncture, the secondary wave preferably encounters the shoreline 33 at an angle that is about normal to the slope of the beach, wherein the plunging wave can continue to form and crest as it passes by.

With wave formations following this pattern, a continuous curling and/or spilling breaker wave can be created along the shoreline extending from about the peninsula point 32 to the base of the cove area 34. That is, a surfable quality curling and/or plunging breaking wave, upon which surfing maneuvers can be performed, can be formed that will last anywhere from five to fifteen seconds, depending on the size of the pool, and length of the section between adjacent peninsulas, which is the typical length of an actual surf ride.

During this phase of the wave formation, the portion of the secondary wave that is in deeper water tends to travel faster than the portion of the wave that is in shallower water, by virtue of friction encountered by the wave. This tends to cause each wave to curve and break along about the same location along the shore. This way, the manner in which the waves are created and break can be controlled, and to a great extent, duplicated from one location of the pool to another, wherein more predictable flow patterns and wave formations can be created thereby.

Although a curling and/or spilling wave will typically be created between the peninsula 32 and cove area 34, once it passes the base of the cove area 34, and encounters the steep slope on the other side of the cove area 34, i.e., between the cove area 34 and the adjacent peninsula 32, the wave will typically break directly onto the shore or beach, i.e., parallel to the shore. In this respect, the secondary wave will typically encounter the steeper portion of the reef 37 directly, thereby resulting in secondary waves that "collapse" or "surge" onto the beach, rather than spill or plunge.

Because the shoreline 33 is undulated, and there are transition areas between the peninsulas 32 and cove areas 34, the waves that break directly onto the bottom of the cove areas 34 will tend to be "collapsing" breaker waves. That is, between the areas where the waves plunge, on one hand, and surge, on the other hand, there is typically an area, which has relatively intermediate to moderate slopes, where the waves will simply collapse.

Because the preferred embodiment of the present invention contemplates that a multiple number of similarly shaped undulations can be provided along the shoreline 33, a single secondary wave can create a multiple number of curling, spilling, plunging, collapsing and surging breaker waves that break individually and repeatedly along different areas of the beach 35. The present invention contemplates that different types of breaker waves can be formed, beginning at different points along the undulations, all along the shoreline 33, one following the other. This enables surfers to not only surf on a number of different types of breaker waves at different locations along the shoreline 33, but also allows people who simply want to wade, or perform skimming maneuvers along the beach, to do so without interfering with the others.

Figure 10A:
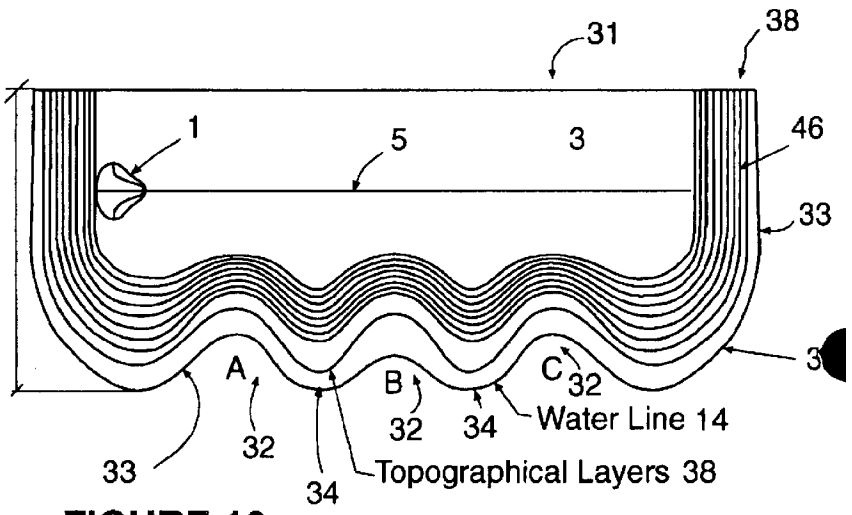

FIGS. 10*a* through 10*e* show the wave generator 1 traveling across the pool 31 from one end to the other in a time lapse manner. FIG. 10*a* shows the wave generator 1 starting out at one end of the track 5. The letters A, B and C (in these figures only) represent the successive undulating peninsulas 32 along the shoreline 33, and the letters A', B' and C' represent the successive undulating cove areas 34. Topographical lines 38 represent how the floor of the pool 31 is sloped, with undulating peninsulas 32, followed by cove areas 34, and then followed again by additional peninsulas 32 and cove areas 34. At the far end 46 of the shoreline 33 is a relatively evenly sloped beach area where the secondary wave will ultimately break directly onto the beach as discussed above.

Figure 10B:
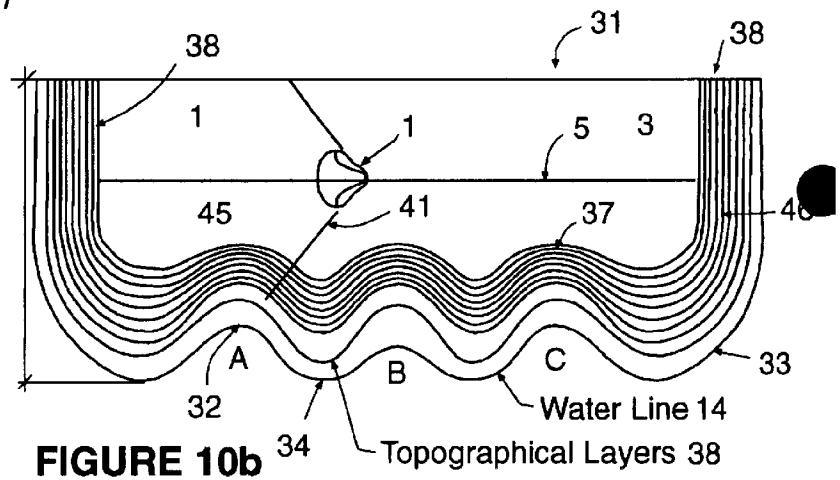

FIG. 10*b* shows the wave generator 1 moving across the pool 31 and creating a secondary wave 41 that begins to break at the first peninsula A. The wave 41 is created by the wave generator 1 and extends like a wake through the deep water areas 45, but as the wave is affected by the reef 37, and its sloped floor, the secondary wave begins to break. In this case, the wave 41 breaks when it encounters the reef 37 at about the third or fourth topographical line 38. The wave encounters the shoreline 33 at an angle that is about normal to the slope of the beach along that portion, and therefore, the wave continues to rise and crest as it passes by. And, assuming a sufficient height of the secondary wave, and because of the moderate to steep incline of the floor at that location, a plunging or spilling breaker wave can be created, upon which surfing maneuvers can best be performed.

In this respect, a rider would typically enter the wave 41 from the peninsula areas 32 and then ride the wave through the curl, or plunging area, which transitions to a spilling wave, until the wave ultimately collapses onto the bottom of the cove area 34. This can, depending on the size of the pool, last anywhere from five to fifteen seconds.

FIG. 10*c* shows the wave generator 1 progressing further across the pool 31 and causing the secondary wave 41 to encounter the reef 37 directly along the shoreline 33 extending between the first cove area A' and second peninsula B. Because the topographical lines of the slope of the reefs floor is about parallel with the wave 41, and the sloped floor rises quickly, the waves here tend to surge quickly onto the beach 35. This is quite different from the phenomenon that occurs where the wave crests, plunges and breaks progressively along the area between the first peninsula A and cove area A' as described above.

FIG. 10*d* shows the wave generator 1 advancing further across the pool 31, wherein the secondary wave 41 encounters the second peninsula B. The wave that encounters this portion also forms a curling and/or spilling breaker wave that travels from the second peninsula B to the base of the second cove area B' where the wave collapses. Because in the preferred embodiment the undulations are similarly shaped from one peninsula to the next, the waves and breaking actions that take place are preferably substantially the same from one area to the next. However, in other embodiments, it may be desirable to vary the topography between undulations in order to create different breaking wave characterizations.

FIG. 10*e* shows the wave generator 1 advancing even further, wherein the secondary wave 41 encounters the third peninsula C. At the far end 46 of the shoreline 33 there is preferably a sloped beach area onto which the secondary wave 41 will ultimately break. This beach area 46 is preferably somewhat evenly sloped so that the wave will spill and/or curl onto the beach, where water skimming maneuvers can be performed, and where people who prefer to wade in the water can do so without fear of interfering with more advanced riders in other areas of the pool.

The present invention contemplates that various undulating patterns, and repetitions of patterns, can be provided. The object of the invention is to use a shoreline with curvatures and slopes to enhance the wave effects created by a single secondary wave traveling across the pool, wherein different types of breaking waves and wave formations can be created, upon which different types of water skimming and surfing maneuvers can be performed.

What is claimed is:

1. A wave pool comprising:

a wave generator capable of traveling substantially across the wave pool and creating wave formations that travel outwardly therefrom; and a shoreline located at a predetermined distance from the wave generator, wherein the shoreline has a contoured floor with undulations, including at least one peninsula followed by at least one cove area, with topographical elevation changes thereon extending along the length of said shoreline, wherein the elevation changes are adapted to substantially alter the wave formations as they travel across the wave pool and toward said shoreline, such that different types of wave formations are formed in different areas along the length of said shoreline.

2. The wave pool of claim 1, wherein said wave generator is adapted to travel along a track in said wave pool, wherein said track is extended substantially horizontally in said wave pool, and said wave generator is adapted to be located on a sled that can slide and/or roll on said track, wherein said wave generator is positioned on said sled such that it can be maintained at a substantially constant level in said water.

3. The wave pool of claim 1, wherein said wave generator is capable of traveling in two directions, such that waves traveling in opposite directions can be created within said wave pool, thereby enabling said wave generator to create four different wave formations traveling in four different directions.

4. The wave pool of claim 1, wherein said wave generator is provided with leading edges and flow forming surfaces having horizontal and vertical curvatures thereon, wherein said flow forming surfaces enable said wave generator to displace water upwardly and laterally in relation to said wave generator, to form curling wave shapes thereon.

5. The wave pool of claim 1, wherein said wave generator is adapted to be able to create both primary and secondary waves, wherein surfing maneuvers can be performed on said primary waves in a relatively deep water environment, and wherein said secondary waves created by said wave generator are capable of traveling through said wave pool and onto said shoreline, wherein various wave formations can be created thereon due to the inclined slope and curvature of said shoreline.

6. The wave pool of claim 1, wherein said wave pool is configured to have substantially identical undulating shorelines extending along either side of said wave generator, wherein the wave formations travel in opposite directions outwardly from said wave generator, and wherein said wave formations travel through said wave pool and break along the shoreline on either side of said wave generator.

7. The wave pool of claim 1, wherein said at least one peninsula followed by said at least one cove area is followed along the length of said shoreline by at least a second peninsula followed by at least a second cove area.

8. The wave pool of claim 1, wherein said wave pool has an undulating shoreline on one side of said wave generator, and a containment wall on the other side of said wave generator.

9. The wave pool of claim 1, wherein said contoured floor is adapted to substantially alter the wave formations as they travel toward the shoreline, and to create first and/or second types of wave formations along an area extending from a first peninsula to an adjacent first cove area, and to create third and/or fourth types of wave formations along an area extending from the first cove area to an adjacent second peninsula.

10. The wave pool of claim 9, wherein said first type of wave formation is a curling wave, and said second type of wave formation is a plunging wave.

11. The wave pool of claim 9, wherein said third type of wave formation is a collapsing wave, and said fourth type of wave formation is a surging wave.

12. The wave pool of claim 9, wherein said first type of wave formation is a curling wave, said second type of wave formation is a plunging wave, said third type of wave formation is a collapsing wave, and said fourth type of wave formation is a surging wave.

13. A wave pool comprising:

a wave generator capable of traveling substantially across the wave pool along a track located in said wave pool, wherein said wave generator is adapted to travel substantially along the surface of said wave pool and create wave formations that travel outwardly therefrom;

a shoreline located at a predetermined distance from the wave generator; and wherein the shoreline has a contoured floor provided with undulations that allow the wave formations created by said wave generator to be enhanced as they travel across the wave pool and onto said shoreline, wherein the contoured floor forms at least one peninsula and an adjacent cove area having alternating topographical elevation changes extending in a direction substantially along the length of said shoreline, wherein the elevation changes are adapted to substantially alter the wave formations created by said wave generator, such that different types of wave formations are formed along said shoreline.

14. The wave pool of claim 13, wherein said track is extended substantially horizontally in said wave pool, and said wave generator is adapted to be located on a sled that can slide and/or roll on said track, wherein said wave generator is positioned on said sled such that it can be maintained at a substantially constant level in said water.

15. The wave pool of claim 13, wherein said wave generator is capable of traveling in two directions, such that waves traveling in opposite directions can be created within said wave pool, thereby enabling said wave generator to create four different wave formations traveling in four different directions.

16. The wave pool of claim 15, wherein said wave generator is adapted to be pivoted around a substantially vertical axis, wherein said wave generator is capable of facing a first direction, and a second direction opposite said first direction, wherein said wave generator is capable of traveling in said first and second directions.

17. The wave pool of claim 15, wherein said wave generator is adapted with two flow forming surfaces facing opposite directions, wherein said wave generator is capable of traveling in a first direction, and a second direction opposite said first direction.

18. The wave pool of claim 13, wherein said wave generator is adapted to be pulled by a cable by mechanical means through said wave pool.

19. The wave pool of claim 13, wherein said wave generator is provided with leading edges and flow forming surfaces having horizontal and vertical curvatures thereon, wherein said flow forming surfaces enable said wave generator to displace water upwardly and laterally in relation to said wave generator to form curling waves thereon.

20. The wave pool of claim 13, wherein said wave generator is adapted to be able to create both primary and secondary waves, wherein surfing maneuvers can be performed on said primary waves in a relatively deep water environment.

21. The wave pool of claim 20, wherein said secondary waves created by said wave generator are capable of traveling through said wave pool and onto said shoreline, wherein various wave formations can be created thereon.

22. The wave pool of claim 13, wherein said contoured floor of said shoreline is adapted to create first and/or second types of wave formations alone an area extending from a first peninsula to an adjacent first cove area, and to create third and/or fourth types of wave formations along an area extending from the first cove area to an adjacent second peninsula.

23. The wave pool of claim 22, wherein said first type of wave formation is a curling wave, and said second type of wave formation is a plunging wave.

24. The wave pool of claim 22, wherein said third type of wave formation is a collapsing wave, and said fourth type of wave formation is a surging wave.

25. The wave pool of claim 22, wherein said wave pool is configured to be symmetrical about said track, with said track extending substantially within the middle of said wave pool, wherein said wave pool has shorelines extending along either side of said track on opposing sides thereof.

26. The wave pool of claim 22, wherein there are multiple peninsulas and cove areas, and each of said multiple peninsulas and cove areas, and the curvatures and slopes associated with them, are substantially identical in shape and size along said shoreline.

27. The wave pool of claim 22, wherein said wave pool has an undulating shoreline on one side of said track, and a containment wall on the other side of said track.

28. The wave pool of claim 14, wherein said sled has rollers thereon for supporting said sled on said track, and wherein said wave generator is connected to a stem extending from said sled.

29. The wave pool of claim 22, wherein said first type of wave formation is a curling wave, said second type of wave formation is a plunging wave, said third type of wave formation is a collapsing wave, and said fourth type of wave formation is a surging wave.

* * * * *